US012127684B2

(12) United States Patent
Kastelic

(10) Patent No.: US 12,127,684 B2
(45) Date of Patent: Oct. 29, 2024

(54) FOLDABLE SEAT

(71) Applicant: Kastelic Holding UG (haftungsbeschraenkt), Berg (DE)

(72) Inventor: Patrick Kastelic, Ravensburg (DE)

(73) Assignee: Kastelic Holding UG (haftungsbeschraenkt), Berg (DE)

( * ) Notice: Subject to any disclaimer, the term of this patent is extended or adjusted under 35 U.S.C. 154(b) by 423 days.

(21) Appl. No.: 17/575,734

(22) Filed: Jan. 14, 2022

(65) Prior Publication Data

US 2022/0225774 A1 Jul. 21, 2022

(30) Foreign Application Priority Data

Jan. 18, 2021 (DE) ..... 10 2021 100 889.1

(51) Int. Cl.
*A47C 4/04* (2006.01)
*A47C 4/08* (2006.01)

(52) U.S. Cl.
CPC ..... *A47C 4/045* (2013.01); *A47C 4/08* (2013.01)

(58) Field of Classification Search
CPC ..... A47C 4/045; A47C 4/04; B65D 1/243
See application file for complete search history.

(56) References Cited

U.S. PATENT DOCUMENTS

| | | | | |
|---|---|---|---|---|
| 3,107,023 A | 10/1963 | Jacobson et al. | | |
| 4,122,638 A | 10/1978 | O'Brian et al. | | |
| 4,630,861 A | 12/1986 | Henschel | | |
| 9,986,843 B2 * | 6/2018 | Baker | A47C 12/00 | |
| 2011/0115350 A1 | 5/2011 | Tsai et al. | | |
| 2014/0131138 A1 * | 5/2014 | Simpson | A47C 12/00 | 182/223 |

FOREIGN PATENT DOCUMENTS

| | | |
|---|---|---|
| CN | 201727152 U | 2/2011 |
| EP | 2 965 661 A1 | 1/2016 |
| EP | 3 284 688 A1 | 2/2018 |
| GB | 563 750 A | 8/1944 |
| JP | 2001-037586 A | 2/2001 |
| JP | 2005-218836 A | 8/2005 |

OTHER PUBLICATIONS

German Office Action in German Application No. 10 2021 100 889.1 dated Jun. 14, 2021 with English translation.

* cited by examiner

*Primary Examiner* — David R Dunn
*Assistant Examiner* — Christopher E Veraa
(74) *Attorney, Agent, or Firm* — Collard & Roe, P.C.

(57) ABSTRACT

Foldable seat, which is foldable between a use position for use as a seat and a storage position for storage and transport of the seat, comprising a two-part top wall for the direct or indirect formation of a seating surface, two two-part A-sidewalls to support the top wall on a floor, two B-sidewalls to support the top wall on a floor, two top wall parts, which are swivelable to each other outwards with a top wall hinge, and form the top wall, whereby the foldable seat comprises at least one locking device for locking of the two top wall parts in the use position of the seat, so that the foldable seat additionally forms a storage box for storing objects on the bottom surface of the top wall with an orientation of the foldable seat with the bottom surface of the top wall upwards.

17 Claims, 9 Drawing Sheets

FOLDABLE SEAT

CROSS REFERENCE TO RELATED APPLICATIONS

This application hereby claims priority under 35 U.S.C. 119 to German Application 10 2021 100 889.1 filed on Jan. 18, 2021 the disclosure of which is hereby incorporated by reference in its entirety.

SPECIFICATION

The present invention relates to a foldable seat.

Foldable seats are used as a seat in a use position. In a storage position in a folded state of the seat, the seat requires little volume and can therefore be easily transported and stored.

U.S. Pat. No. 4,630,861 discloses a foldable stool comprising a seat surface and a side surface.

The U.S. Pat. No. 4,122,638 A shows a foldable structure for gaming purposes. End walls are formed on the foldable structure with adjacent edges, which are connected to hinges on the sides.

The U.S. Pat. No. 3,107,023 A shows a stackable container.

The U.S. Pat. No. 4,630,861 A reveals a collapsible chair.

The EP 3 284 688 A1 shows a folding seat. The seat with a top wall and four sidewalls is in use position in the geometry and shape of a cube. In a less advantageous way, the seat without floor wall, i.e. open at the bottom, cannot be used in a 180° swivel state for the storage and custody of objects, because it is always possible to swivel the two top wall parts of the top wall to each other outwards with a top wall hinge.

SUMMARY

The object of the present invention is therefore to provide a foldable seat in which the seat can also be used as a storage box for storing objects.

This object is achieved with a foldable seat, which is foldable between a use position for use as a seat and a storage position for storage and transport of the seat, comprising a two-part top wall for the direct or indirect formation of a seating surface on an upwardly oriented top surface of the top wall and a bottom surface of the top wall is aligned inwards and opposite to the top surface of the top wall in the use position, two two-part A-sidewalls to support the top wall on a floor, two B-sidewalls to support the top wall on a floor, two top wall parts, which are swivelable to each other outwards with a top wall hinge, and form the top wall, each two A-sidewall parts per A-sidewall, which are jointly connected to each other with a sidewall hinge and are swivelable to each other, and each two A-sidewall parts form an A-sidewall, two top wall connection hinges and with each one top wall connection hinge one top wall part is jointly connected to one B-sidewall, so that the top wall parts are swivelable to the B-sidewalls, four sidewall connection hinges and with each one sidewall connection hinge one A-sidewall part is jointly connected to one B-sidewall, so that the A-sidewall parts are swivelable to the B-sidewalls, whereby the foldable seat comprises at least one locking device for locking of the two top wall parts in the use position of the seat and in the locked state of at least one locking device a swiveling of the two top wall parts with the top wall hinge is blocked to each other to the outside to absorb compressive forces on the bottom surface of the top wall, so that the foldable seat additionally forms a storage box for storing objects on the bottom surface of the top wall with an orientation of the foldable seat with the bottom surface of the top wall upwards and the at least one locking device comprises each at least one form-fitting element and each at least one counter form-fitting element and in the locked state each of one locking device the at least one form-fitting element is form-fitting connected to at least one counter form-fitting element and the at least one form-fitting element is formed at the top wall and the at least one counter form-fitting element is formed at the A-sidewall or vice versa.

Preferably, in the use position, the two top wall parts are in the main parallel and/or at an angle of substantially 180° to each other aligned and/or in the storage position the two top wall parts are aligned at an acute angle to each other. Conveniently, the acute angle is between 3° and 30°. In the main parallel and/or in the main aligned at an angle of 180° or 90° to each other means preferably with a deviation of less than 30°, 20° or 10°.

In a further embodiment, with the at least one locking device additionally the swiveling of the two top wall parts to each other is blocked inwards.

In a further variant, with the at least one locking device the top wall is detachably fixed form-fitting and/or force-locking at an A-sidewall or at both A-sidewalls in the use position.

In a supplementary embodiment, with a first locking device the top wall is detachably fixed at a first A-sidewall and preferably with a second locking device the top wall is detachably fixed at a second A-sidewall in the use position.

In a supplementary embodiment, each of the one form-fitting element has a support surface and each of the one counter form-fitting element has one counter-support surface and in the locked state each of the one support surface bears on each of the one counter-support surface.

In a supplementary variant, each of the one form-fitting element is formed as a locking nose formed at the top wall or as a locking bolt formed at the top wall and each of the one counter form-fitting element is an area of the A-sidewall with the counter-support surface or is formed as a stub with a locking recess, in particular locking bore, formed at the A-sidewall or each of the one form-fitting element is formed as a locking nose formed at the A-sidewall or as a locking bolt formed at the A-sidewall and each of the one counter form-fitting element is an area of the top wall with the counter-support surface or is formed as a stub with a locking recess, in particular locking bore, formed at the top wall.

In a further embodiment, each of the one form-fitting element is stationary and immovably connected to the top wall or the A-sidewall and each of the one counter form-fitting element is movably connected by each one locking mechanism with the top wall or the A-sidewall or each of the one form-fitting element is movably connected by each one locking mechanism with the top wall or the A-sidewall and each of the one counter form-fitting element is stationary and immovably connected to the top wall or the A-sidewall.

In a further embodiment, each of the one support surface and/or at least one counter-support surface is in the use position at least partially aligned in the main perpendicular to the A-sidewall. In the main vertical means preferably with a deviation of less than 30°, 20° or 10°.

In a supplementary variant, the geometry of the each one form-fitting element and the each one counter form-fitting element are complementary to each other. A complementary geometry of the form-fitting element and counter-form-fitting element enables a secure form-fitting connection at low maximum forces, in particular compressive forces, on the support surface and counter-support surface. A in the main punctual transfer of forces can thus be avoided.

In a further embodiment, when used as a foldable storage box in the use position, the compressive force applied on the bottom surface of the top wall without a contact of the seat, in particular the top wall, with a floor at least partially applies as a compressive force between each of the one support surface and each of the one counter-support surface. For example, when carrying the storage box with a carrying handle, the compressive forces of objects applied to the bottom surface of the top wall are transferred as compressive forces between the support surface and counter-support surface.

Preferably, at the end regions of the A-sidewall parts, which are connected by the sidewall hinges jointly, hinge bores are formed and each one sidewall hinge is formed by a hinge axis arranged in the hinge bores of two A-sidewall parts.

In a further embodiment, the seat in the use position is in the main cuboid-shaped, in particular in the main cube-shaped, without floor wall and the bottom surfaces of the A-sidewalls and B-sidewalls function for support on a floor. In the main cuboid-shaped means that the seat with a deviation of less than 30%, 20% or 10% with regard to the length and/or width and/or height is formed as a cuboid, in particular cube.

In a further variant, in the use position each of two A-sidewall parts per A-sidewall are in the main parallel to each other and/or at an angle of in the main 180° to each other and/or are arranged in one plane and with at least one limit stop a swiveling of each of the two A-sidewall parts per A-sidewall is blocked from this position to the outside.

In a further embodiment, in the use position the A-sidewalls and B-sidewalls are in the main perpendicular to the top wall. Preferably, in the use position the opposite A-sidewalls are in the main aligned parallel to each other. Preferably, in the use position the opposite B-sidewalls are in the main aligned parallel to each other. Conveniently, in the use position the A-sidewalls and B-sidewalls are in the main aligned perpendicular to each other. In the main perpendicular and/or parallel aligned to each other means preferably with a deviation of less than 30°, 20° or 10°.

Preferably, the volume of the seat in the storage position is less than 50% or 30% or 20% of the volume of the seat in the use position.

In a further variant, the top wall and/or the A-sidewalls and/or B-sidewalls is bending resistant and/or at least partially, in particular completely or at least 70% by volume or mass, 80% by volume or mass or 90% by volume or mass, are made of plastic and/or at least partially, in particular completely or at least 70% by volume or mass, 80% by volume or mass or 90% by volume or mass, made of metal.

In an additional embodiment, the top wall and/or the A-sidewalls and/or the B-sidewalls are formed as, preferably flat, preferably rigid, grid and/or grill and/or framework and/or plate with or without openings.

In a further variant, at the inner surfaces and/or outer surfaces of the top wall and/or A-sidewalls and/or B-sidewalls stiffening ribs are formed. The inner surface of the top wall is the bottom surface of the top wall and the outer surface of the top wall is the top surface of the top wall.

In a further embodiment, each one locking nose is formed with a support surface, in particular undercut.

In one variant, the locking nose is fixed at the top wall and in the locked state the support surface of the locking nose bears on the counter-support surface of the A-sidewall or vice versa.

Conveniently, the support surface and/or counter-support surface is in the main aligned parallel to the top wall in the use position and/or is in the main aligned perpendicular to the A-sidewall in the use position. In the main perpendicular and/or parallel aligned means preferably with a deviation of less than 30°, 20° or 10°.

In a supplementary variant, in the use position an end as form-fitting element of each one hinge axis is arranged in a recess as counter form-fitting element at the top wall, so that a swiveling of each two A-sidewall parts, especially inwards, is blocked.

In an additional embodiment, the each one hinge axis is in the direction of a longitudinal axis of the hinge axis and/or swivel axis of the sidewall hinge is movably supported, so that in a locked position in the locked state of the at least one locking device of the hinge axis, the hinge axis is arranged in the recess and in a unlocked position in the unlocked state of the at least one locking device, the hinge axis is arranged outside the recess, so that in the unlocked position the two A-sidewall parts are swivelable to each other, in particular inwards.

In a further variant, in the locked position the each one hinge axis is fixable with a fixing means, in particular in the use position of the seat or the storage box.

Preferably, the at least one locking device, in particular exclusively, is integrated in the top wall hinge.

In a supplementary embodiment, at least one latching nose is fixed to a first top wall part as a form-fitting element movable between a locked position and a unlocked position and in a second top wall part at least one locking recess is formed as a counter form-fitting element and in the use position the at least one latching nose is positioned in the locked position, so that the at least one locking nose is arranged in the at least one locking recess and the swiveling of the two top wall parts to each other is blocked and in the unlocked position of at least one latching nose, the at least one locking nose is positioned outside the locked position and the two top wall parts are swivelable to each other.

In a further embodiment, the locking device is integrated in the top wall, in particular the top wall hinge, and/or is integrated in at least one A-sidewall, in particular at least one side wall hinge.

In a further embodiment, the seat comprises a wrapping and in the use position the wrapping covers the top wall completely and the A-sidewalls and B-sidewalls at least partially, in particular completely. Conveniently, the wrapping is made of a fabric and/or a film. Preferably, the wrapping is attached with at least one strap, in particular tightening strap, at the A-sidewall and/or B-sidewall and/or top wall.

In a further embodiment, in the storage position the seat is locked with a holding device in the storage position, so that the seat is not foldable from the storage position to the use position without releasing the holding device.

In a further variant, in the locked state of at least one locking device, a swiveling of the two top wall parts with the top wall hinge to each other to the outside is blocked by at least one top wall connection hinge, which is blocked or locked with the at least locking device. Due to the kinematics of the seat and/or the storage box, the top wall hinge is thus also locked due to the locking of the at least one top wall connection hinge.

In a further embodiment, the at least one form-fitting element is stationary and immovably formed at the top wall and the at least one counter form-fitting element is stationary and immovably formed at the A-sidewall, so that no relative movement between the at least one form-fitting element at the top wall is executable and no relative movement between the at least one counter form-fitting element and the A-sidewall is executable or the at least one counter form-fitting element is stationary and immovably formed at the top wall and the at least one form-fitting element is stationary and immovably formed at the A-sidewall, so that no relative movement between the at least one counter form-fitting element at the top wall is executable and no relative movement between the at least one form-fitting element and the A-side wall is executable.

In a further variant, the two top wall parts have the in the main same size, in particular in the main the same length and/or width. In the main means preferably with a deviation of less than 30%, 20% or 10%.

In a further variant, two A-sidewall parts each have the in the main same size, in particular in the main the same length and/or width. In the main means preferably with a deviation of less than 30%, 20% or 10%.

In a further variant, the two A-sidewalls have the in the main same size, in particular in the main the same length and/or width. In the main means preferably with a deviation of less than 30%, 20% or 10%.

In a further variant, the two B-sidewalls have the in the main same size, in particular in the main the same length and/or width. In the main means preferably with a deviation of less than 30%, 20% or 10%.

BRIEF DESCRIPTION OF THE DRAWINGS

In the following, embodiments of the invention are described in more detail with reference to the attached drawings.

It shows.

DETAILED DESCRIPTION

Figure 1:
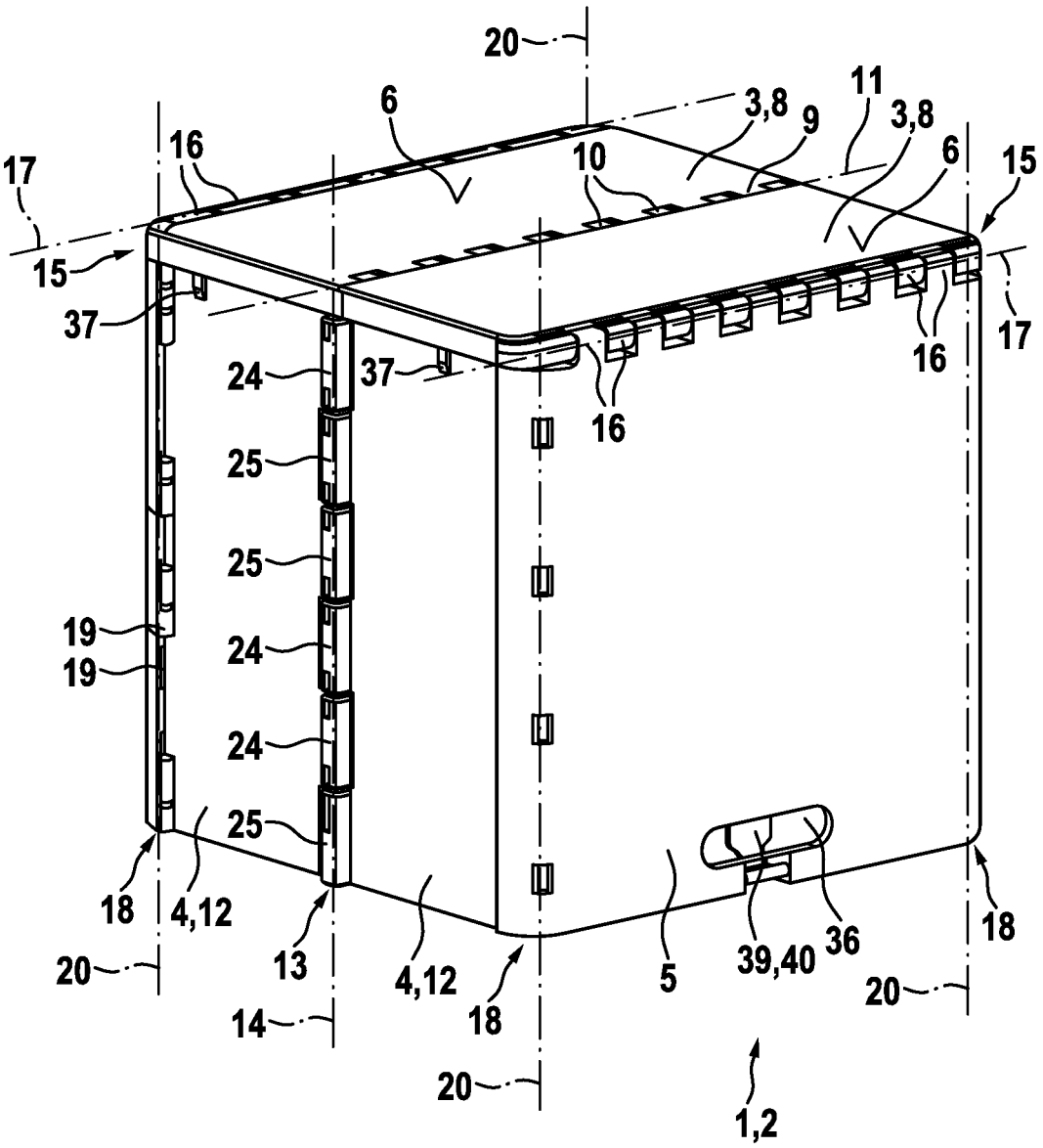
FIG. 1 a perspective view of a foldable seat in a use position when used as a seat, FIG. 2 a perspective view of the foldable seat according to FIG. 1 in an intermediate position between the use position and a storage position, FIG. 3 a perspective view of the foldable seat according to FIG. 1 in the storage position, FIG. 4 a detailed view of a sidewall hinge of the foldable seat according to FIG. 1, FIG. 5 a perspective view of the foldable seat according to FIG. 1 in a use position when used as a storage box, FIG. 6 a detailed view from the outside of an A-sidewall with two A-sidewall parts of the foldable seat according to FIG. 1, FIG. 7 a detailed view of a locking device in a first embodiment at a top wall hinge and a part of the A-sidewall in the area of the locking device in an interior view of the foldable seat according to FIG. 1, FIG. 8 a cut through the locking device according to FIG. 7 with a cutting plane parallel to a swivel axis of the top wall hinge and perpendicular to the top wall, FIG. 9 a cut through the locking device with a cutting plane parallel to a swivel axis of the top wall hinge and perpendicular to the top wall of a folding seat in a second embodiment.

FIGS. 1 to 8 show a first embodiment of a foldable seat 1. The foldable seat 1 is foldable between a use position for use as a seat and a storage position for storage and transport of seat 1. The foldable seat 1 comprises a top wall 3, two A-sidewalls 4 and two B-sidewalls 5. The top wall 3, the two A-sidewalls 4 and the two B-sidewalls 5 are formed as in the main flat, rigid plates without openings. Different from this, the top wall 3, the two A-sidewalls 4 and the two B-sidewalls 5 can also be formed as a flat, rigid grid, grill, framework or plate with openings. The top wall 3, the two A-side walls 4 and the two B-side walls 5 are formed at the inside surfaces with stiffening ribs and the stiffening ribs are shown only in FIG. 4. The top wall 3 is in the use position in the main square and in the main horizontally aligned with a top surface 6 and a bottom surface 7. The top surface 6 functions as a direct seat surface or as an indirect seat surface, if on the top surface 6 a seat cushion (not shown), preferably elastic, is arranged. For fastening the seat cushion, 4 fastening elements, in particular lugs 37 or hooks, are formed at two opposite edge areas near the A-sidewalls. In the use position, the two opposite A-sidewalls 4 are in the main square and in the main vertically aligned. In the use position, the two opposite B-sidewalls 4 are also in the main square and in the main vertically aligned. The top wall 3 is in the use position in the main horizontally aligned. A lower end of the A-sidewalls 4 and B-sidewalls 5 serve as support surfaces 46 to place the seat 1 on a floor. Seat 1 may be enclosed by a wrapping (not shown). The wrapping not shown is fastened with elastic tightening straps and to guide the tightening straps around the support surfaces 46, on the support surfaces 46 recesses 38 are formed. At the recesses 38, the lower ends of A-sidewalls 4 and B-sidewalls 5 do not function as support surfaces 46 on a floor.

The top wall 3 is designed in two parts with two top wall parts 8. The two top wall parts 8 have the in the main the same size, i.e. length and width, and are swivelable with a top wall hinge 9 around a swivel axis 11 to each other, so that in the storage position (FIG. 3) the two top wall parts 8 are aligned almost parallel to each other at a very small acute angle of about 10°. The top wall hinge 9 is formed by teeth 10 and a not shown hinge axis as a hinge bolt. At the edge of the two top wall parts 8 teeth 10 are formed, which interlock, and in the teeth 10 aligned hinge bores (not shown) are incorporated. The hinge axis is arranged in the hinge bores, so that the swivel axis 11 of the top wall hinge 9 corresponds to a centric longitudinal axis of the hinge axis respectively the hinge bore. The two top wall parts 8 are by each one top wall connection hinge 15 swivelable around a swivel axis 17 and are jointly connected to the B-sidewalls 5. The top wall connection hinge 15 is formed by teeth 16. The teeth 16 are provided with aligned hinge bores (not shown). A hinge axis (not shown) is arranged in the hinge bores, so that the swivel axis 17 of the top wall connection hinge 15 corresponds to a centric longitudinal axis of the hinge axis respectively the hinge bolt.

The A-sidewalls 4 are each designed with two parts with two A-sidewall parts 12. The two A-sidewall parts 12 have the in the main the same size, i.e. length and width, and are swivelable with a sidewall hinge 13 (FIGS. 1, 2 and 4) around a swivel axis 14 to each other, so that in the storage position (FIG. 3) the two top wall parts 8 are aligned parallel to each other and stacked. The top wall hinge 9 is designed by teeth 24, 25 and a hinge axis 27 as a hinge bolt 27. First teeth 24 are formed at a first A-sidewall part 12 and second teeth 25 are formed at a second A-sidewall part 12. At an edge of the first and second A-sidewall parts 12, the teeth 24, 25 are formed, which interlock, and in the teeth 24, 25 are incorporated aligned hinge bores 26. The swivel axis 27 is arranged in the hinge bore 26, so that the swivel axis 14 each of one A-sidewall hinge 13 corresponds to a centric longitudinal axis of the hinge axis 27 respectively the hinge bolt 27. Ends of the first teeth 24 each form a limit stop 41 (FIG. 4), which in the use position (FIG. 1) bear on the second A-sidewall part 12 and ends of the second teeth 25 each form a limit stop 41 (FIG. 4), which in the use position (FIG. 1) bear on the first A-sidewall part 12, so that in the use position the two sidewall parts 12 are in the main not swivelable outwards, i.e. the swivel movement of each of the two sidewall parts 12 to each other is blocked outwards from the relative position to each other in the use position of seat 1. The two A-sidewall parts 12 are thus only swivelable inwards to each other, if this is not blocked by a locking device 21.

Figure 5:
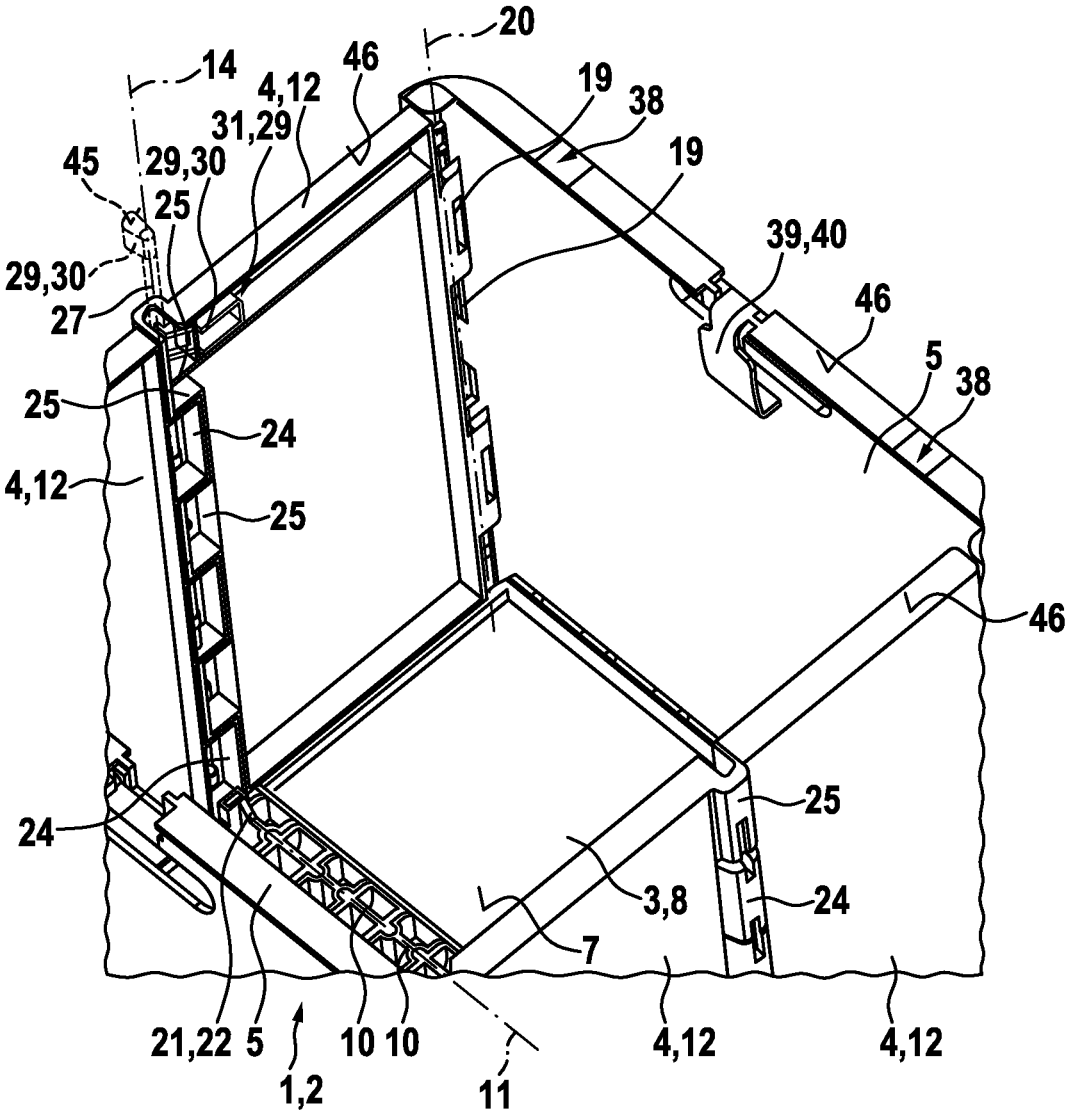

A A-sidewall part 12 is by each one side wall connection hinge 18 swivelable around a swivel axis 20 and is jointly connected to the B-sidewall 5. The sidewall connection hinge 18 is formed by teeth 19 (FIG. 5). The teeth 19 are designed with aligned hinge bores (not shown). A hinge axis is arranged in the hinge bores, so that the swivel axis 20 of the sidewall connection hinge 18 corresponds to a centric longitudinal axis of the hinge axis respectively the hinge bolt (not shown). At each one B-sidewall 5, two A-sidewall parts 12 are by each one sidewall connecting hinge 18 jointly connected to the each of one B-sidewall 5. In the use position in FIG. 1, the foldable seat 1 is in the main formed as a cube without floor walling, i.e. open at the bottom. The lower ends of the A-sidewalls 4 and the B-sidewalls 5 serve for support on the floor. The two top wall parts 8 and thus also the top wall 3 bears on two outer strip-shaped edge areas on the A-sidewalls 4, so that compressive forces applying on the top surface 6 of the top wall 3, because of the bearing of the stripe-shaped edge areas on the A-sidewalls 4, are transferred from the A-sidewalls 4 to the floor. Furthermore, the two top wall parts 8 are connected by the top wall connection hinges 15 with the B-sidewalls 5, so that the compressive forces applying on the top surface 6 of the top wall 3 are also transferred from the B-sidewalls 5 into the floor.

In the use position, each one end region of the top wall 3 is connected to an end region of the A-sidewall 4 by the locking device 21 in a form-fitting detachable way, so that a swiveling of the two top wall parts 8 is blocked outwards and a swiveling of the two A-sidewall parts 12 is blocked inwards. The top wall 3 is connected by a first locking device 21 at a first A-sidewall 4 in a form-fitting detachable way and is connected by a second locking device 21 at another, second opposite A-sidewall 4 in a form-fitting detachable way in the use position. Two end regions of the top wall 3 are connected to each one end region of the A-sidewall 4, so that both A-sidewalls are connected in a form-fitting and detachable way by two locking devices 21 at the top wall 3. On each of the last tooth 10 is a locking nose 22 (FIGS. 7 and 8) formed as a form-fitting element 49 as an extension of the last tooth 10 with an undercut 23. This undercut 23 bears on a counter-support surface 42 on the first tooth 24 as the uppermost tooth 24 of the sidewall hinge 13 in the use position of the seat 1. Thus, the tooth 24 forms a counter form-fitting element 50 at the counter-support surface 42. This first tooth 24 has a counter-support surface 42 and the undercut 23 forms a support surface 43. Thus, the support surface 43 bears on the locking nose 22 as form-fitting element 49 on the counter-support surface 42 at the tooth 24 as counter form-fitting element 50. The hinge axes 27 as the hinge bolts 27 are movable in the two sidewall hinges 13 in the hinge bores 26 (FIG. 4) and can thus be moved between a locked position and a unlocked position.

Figure 6:
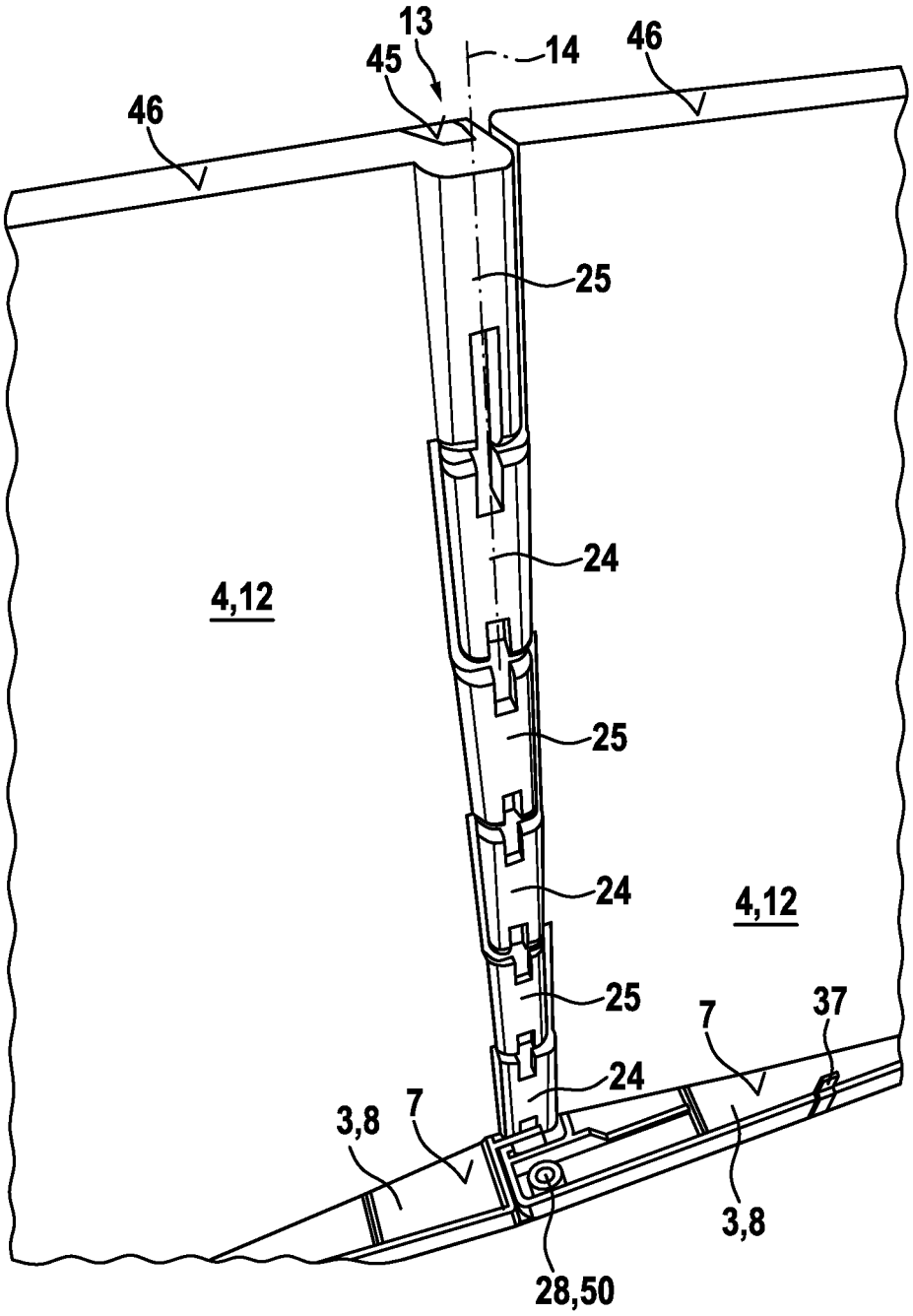
Figure 7:
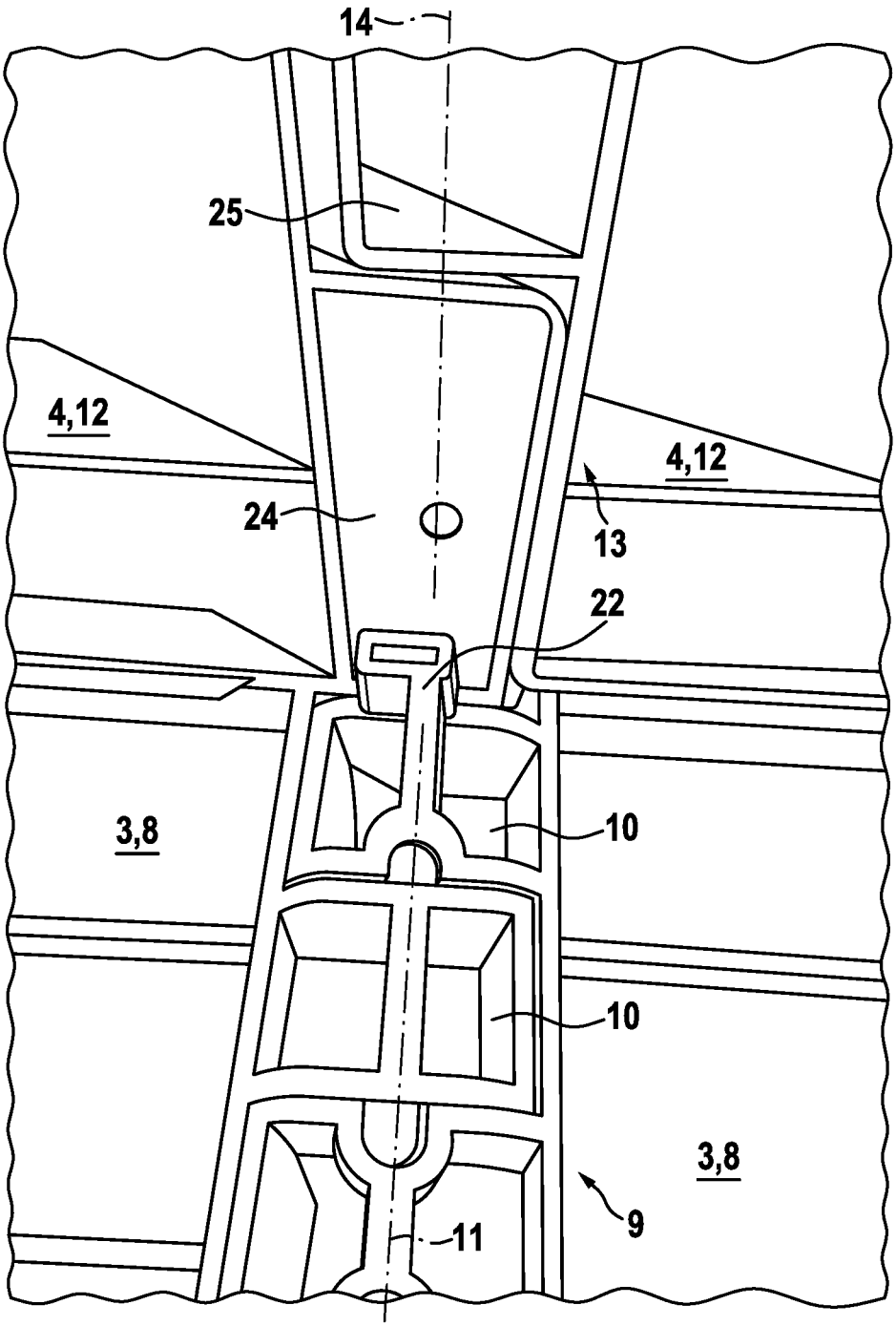
Figure 8:
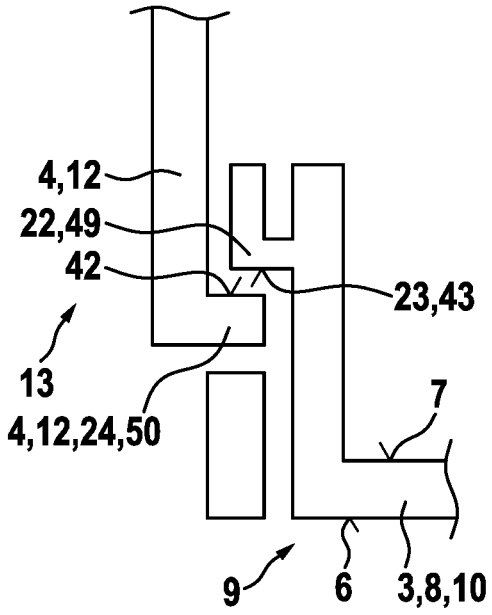

In the pulled-out position, the hinge bolt 27 with constant diameter is pulled out of one or a few hinge bores 26 and is shown in this pulled out position in FIG. 5 dashed and is thus in the unlocked position, i. e an end 44 of the hinge bolt 27 is positioned outside a recess 28 (FIG. 6). At the bottom surface 7 of the top wall 3 two cylindrical jacket-shaped recesses 28 (in FIG. 6 the two A-side wall parts 12 are slightly folded inwards, so that the recess 28 is visible) are formed. In the locked position (hinge bolt 27 with actuating element 30 shown in FIG. 5 with solid line) of the swivel axis 27 is the end 44 of the swivel axis 27 as form-fitting element 49 in the recess 28 as counter form-fitting element 50, so that a folding of the two A-sidewall parts 12 on each one A-sidewall 4 is blocked outwards and inwards, so that due to the blocking to the outside, the undercut 23 as the support surface 43 always bears on the counter-support surface 42 and thus the two A-sidewalls 4 are reliably locked detachably and fixed detachably at the top wall 4. On the hinge axis 27 at one end 45 of the hinge axis 27, opposite to the end 44, which is located in the recess 28, the actuating element 30 is formed as a widening or as a handle. In the locked position of the swivel axis 27, the actuating element 30 is arranged in a bearing cavity 31 at the inner surface of an A-sidewall part 12 (FIG. 5), so that a movement of the swivel axis 27 is blocked in the hinge bores 26. The actuator element 30 and the bearing cavity 31 thus forms a fixing means 29 for temporary fixing of the hinge axis 27 in the locked position in the use position of the seat 1 and the storage box 2. The blocking of the two A-sidewall parts 12 outwards with the limit stops 41 at teeth 24, 25 is usually not sufficient reliable and accurate for the reliable arrangement of the support surface 43 on the counter-support surface 42.

With the locking device 21, formed by the locking nose 22 as a form-fitting element 49 with support surface 32 and the tooth 24 as a counter form-fitting element 50 and the hinge axis 27 as a form-fitting element 49 and the recess 28 as counter form-fitting element 50 are in the use position the last teeth 10 of the top wall hinge 9 safely and reliably connected with the A-sidewalls 4, so that in a use position with an orientation of the top surface 6 of the top wall 3 downwards (FIG. 5) the foldable seat 1 also functions as a foldable storage box 2 for storing objects on the bottom surface 7 of the top wall 3 as the floor surface of the storage box 2. The inner surfaces of the A-sidewall 4 and the B-sidewall 5 also serve as support surfaces for the objects as stored goods. The compressive forces applied by the stored goods (not shown) to the bottom surface 7 of the top wall 3 are transferred from the support surface 43 at the locking nose 22 and the counter-support surface 42 at the first tooth 24 to the A-sidewalls 4.

Figure 2:
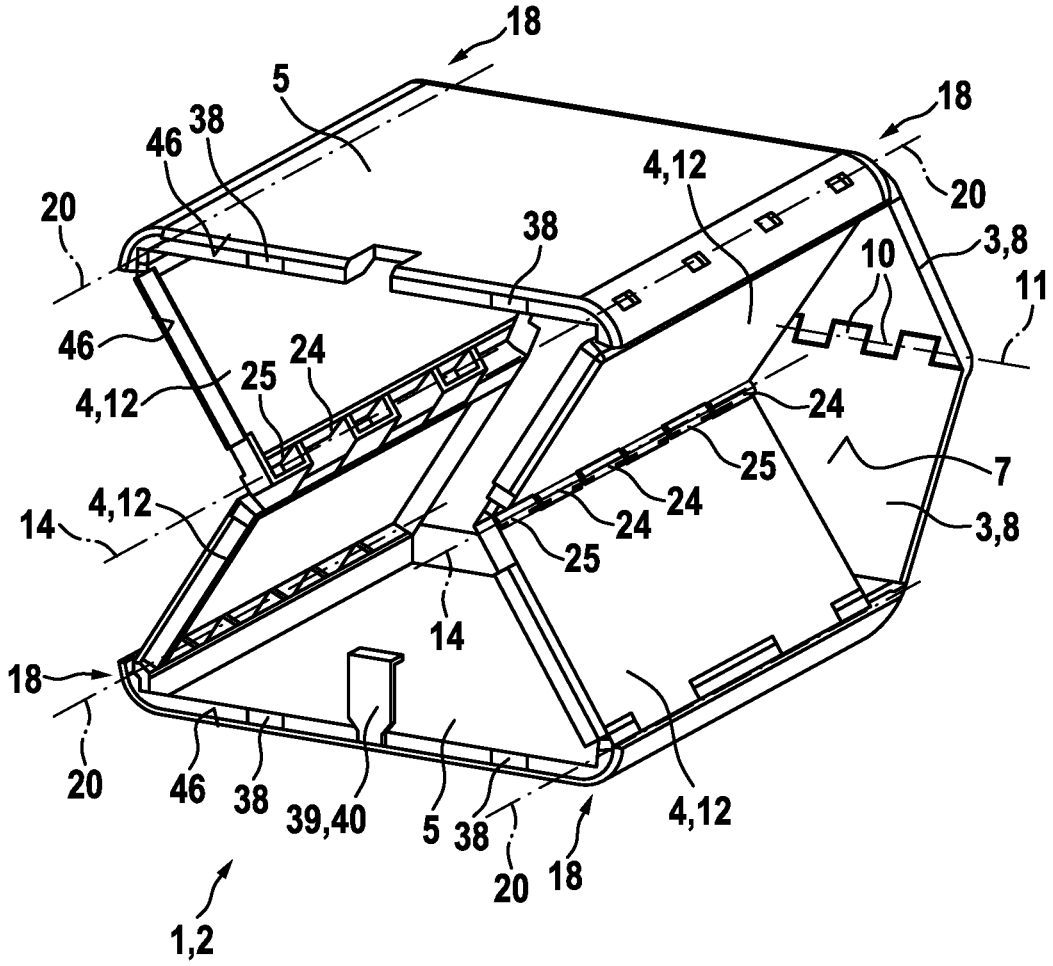
Figure 3:
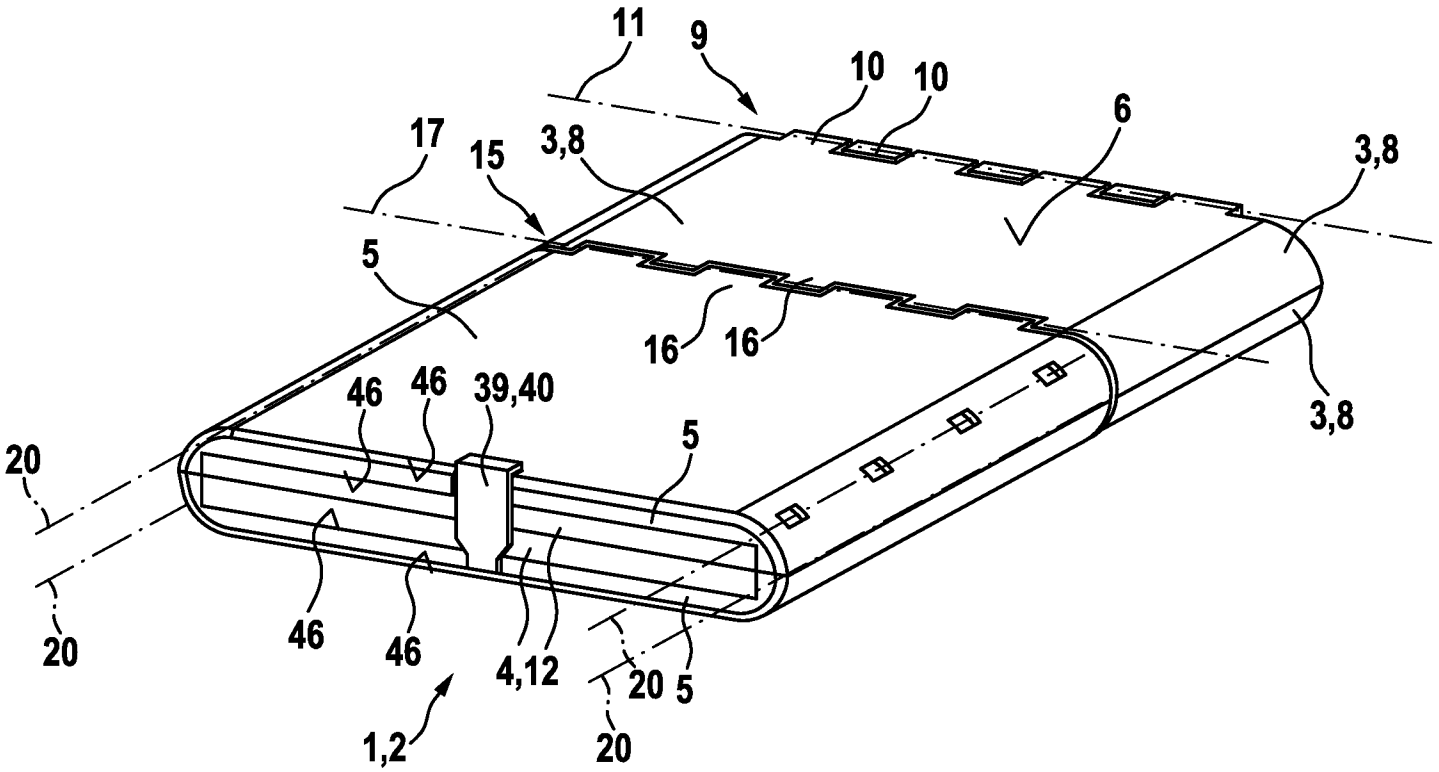
Figure 4:
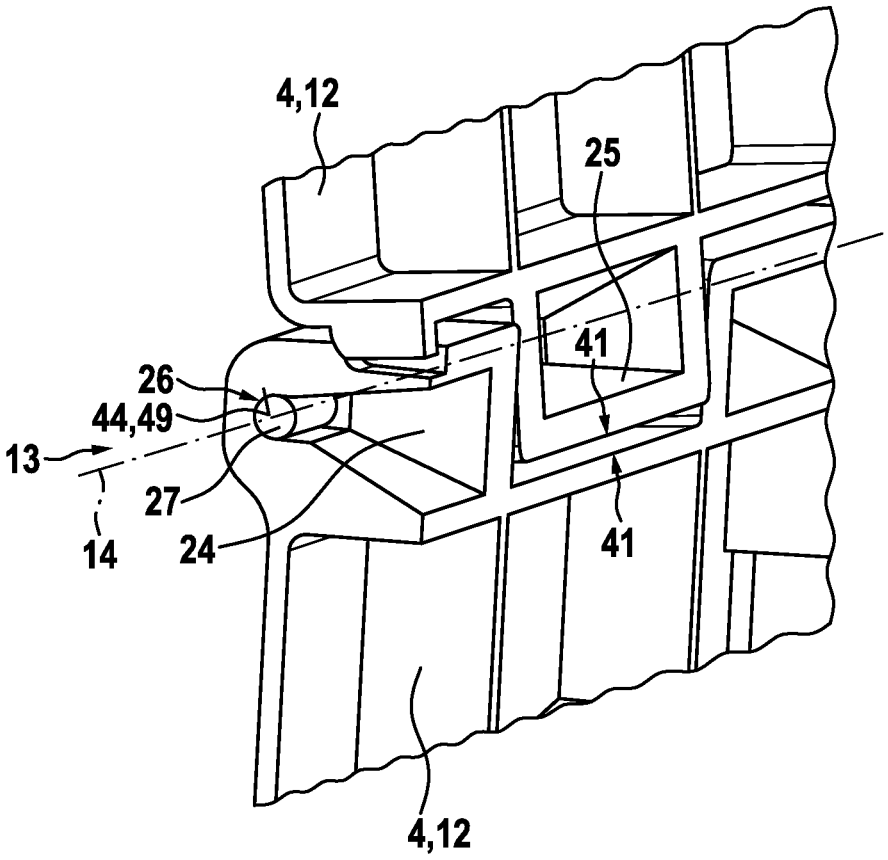

FIG. 2 shows an intermediate position between the use position (FIG. 1) and the storage position (FIG. 3). To fold the seat 1 and the storage box 2 from the use position (FIGS. 1 and 5) into the storage position (FIG. 3), the two actuating elements 30 of the two hinge axes 27 must first be manually removed from the bearing cavities 31 and then the two hinge axes 27 are to be moved slightly out of the hinge bores 26, so that the ends 45 of the hinge axes 27 with the actuators 30 slightly overtop the support surfaces 46 of the A-sidewalls 4 and thus the ends 44 are arranged outside the recesses 28. Subsequently, the end regions of the A-sidewall parts 12 near the locking noses 22 are to be moved slightly outwards (this is slightly possible despite the limit stops 41 in the sidewall hinges 13), so that the support surfaces 43 of the two locking noses 22 no longer bear on the counter-support surfaces 42 of the first two teeth 24 of the sidewall hinge 13. Subsequently, the two top wall parts 8 are swiveled outwards and the four A-sidewall parts 12 of the two A-sidewalls 4 are swiveled inwards (FIG. 2). These movements are continued until in the storage position (FIG. 3) two A-sidewall parts 12 each of one A-sidewall 4 are stacked and in the main arranged parallel to each other between two B-sidewalls 5. The two top wall parts 8 are stacked in the storage position and aligned at an acute angle to each other. In the storage position, seat 1 and storage box 2 can be easily transported and requires a much smaller volume compared to the use position. In the storage position, with the holding device 39 as a holding clamp 40, the two B-sidewalls 5 are connected to each other in the area of the support surfaces 46, so that the storage position is permanently fixed until the connection between the two B-sidewalls 5 is loosened by means of a loosening of the holding clamp 40. The top and bottom information of seat 1 and storage box 2 refers to the alignment in the use position of the seat 1.

Figure 9:
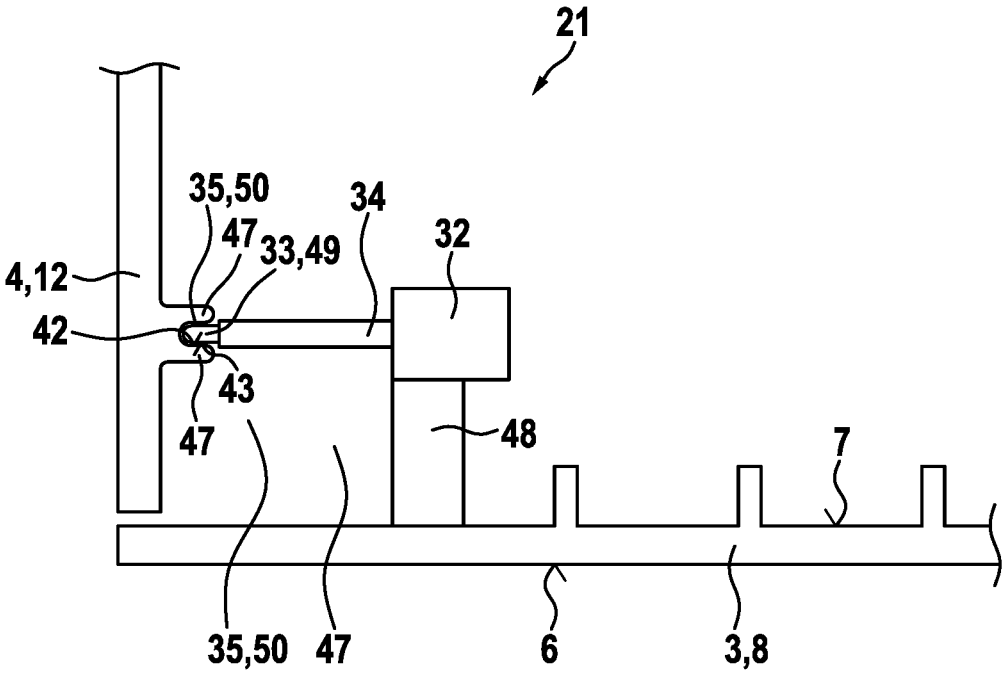

FIG. 9 shows a second embodiment of the foldable seat 1 and the foldable storage box 2. In the following, in the main only the differences to the first embodiment according to FIG. 1 to 8 are described. The second embodiment differs in the main only by the other design of the locking device 21 from the first embodiment. In the second embodiment, the limit stop 41 in the sidewall hinge is formed in such a way that the A-sidewall parts 12 are exactly and precisely not swivelable outwards, so that no locking with the end 49 of the hinge axis 27 in the recess 28 according to the first embodiment in the use position is necessary. A stub 47 is attached to an A-sidewall part 12, i.e. not to the sidewall hinge 13. However, the stub 47 is formed near the sidewall hinge 13. The stub 47 is formed in one piece together with the A-sidewall part 12 or in two parts as a separate component. In the stub 47 a locking recess 35 as a locking bore 35 as a counter form-fitting element 50 is formed. The locking bore 35 is in the main aligned perpendicular to the A-sidewall 4 and/or in the main parallel to the top wall 3 in the use position. At a top wall part 8, i.e. not on the top wall hinge 9, a connection stub 48 is formed near the top wall hinge 9. A locking mechanism 32 is attached to the connection stub 48. The locking bolt 33 is connected to the locking mechanism 32 with a connecting rod 34. The locking mechanism 32 with an actuator element not shown, in particular an actuation head, serves to move the locking bolt 33 as a form-fitting element 49 with the connecting rod 34 between a locked position (FIG. 9) and a unlocked position (not shown). The connecting rod 34 and the locking bolt 33 are in the locked position and in the unlocked position fixable in a detachable way. In the locked position, the locking bolt 33 is arranged in the locking bore 35, so that the connecting bore 35 forms the counter form-fitting element 50 and thus the A-sidewall 4 is connected to the top wall 3, so that a swiveling of the two top wall parts 8 to the outside is blocked. The two A-sidewall parts 12 neither cannot be swiveled inwards (due to the form-fitting element 49 and the counter form-fitting element 50) or nor outwards (due to the limit stop 41). The two top wall parts 8 cannot be swiveled outwards because of the form-fitting connection between the form-fitting element 49 and the counter form-fitting element 50. Compressive forces, applied by stored goods to the bottom surface 7 of the top wall 3, are transferred from the support surface 43 at the locking bolt 33 as form-fitting element 49 to the counter-support surface 42 at the locking bore 35 as counter form-fitting element 50 and then from the stub 47 in the A-sidewall 4. The top wall parts 8 cannot be swiveled inwards, because they bear on the two A-sidewalls 4. The seat 1 and the storage box 2 is designed with two of these locking devices 21 at two opposite A-sidewalls 4. In the unlocked position (not shown), the locking bolt 33 is arranged outside the locking bore 35 as a locking recess 35, so that the two top wall parts 8 can be swiveled outwards and then the A-sidewall parts 12 inwards for folding the seat 1 and the storage box 2 from the use position to the storage position. In the second embodiment, two locking devices 21 are formed at each one A-sidewall 4.

Overall, the folding seat 1 and the foldable storage box 2 according to the invention are associated with significant advantages. In the use position of seat 1, the end regions of top wall 3 are detachably fixed in a form-fitting way to each one A-sidewall 4 with two locking devices 21, so that the swiveling of the two top wall parts 8 is not blocked outwards. Inwardly, the swiveling of the two top wall parts 8 is blocked both by the two locking devices 21 and due to the bearing of the edge areas of the bottom surface 7 of the top wall 3 on the upper ends of the A-sidewalls 4. In addition, with the two locking devices 21, the swiveling of the four A-sidewall parts 12 of the two A-sidewalls 4 is blocked inwards and outwards. In addition, the swiveling of the four A-sidewall parts 12 of the two A-sidewalls 4 to the outside is blocked due to the constructive design of the sidewall hinges 13. Thus, the foldable seat 1 has a greater stability in the use position, because during use as a folding seat 1 the sidewall hinges 13 cannot be unintentionally folded inwards. The locking devices 21 allows the use of seat 1 as a storage box 2. The storage box 2 corresponds to seat 1 rotated by 180°, so that the top wall 3 forms the floor wall of the storage box 2. Recesses 36 can be used as carrying handles 36 for seat 1 as well as for storage box 2.

Accordingly, while several embodiments of the present invention have been shown and described, it is obvious that many changes and modifications may be made thereunto without departing from the spirit and scope of the invention.

The invention claimed is:

1. A foldable seat, which is foldable between a use position for use as a seat and a storage position for storage and transport of the seat, comprising:

a two-part top wall having a top surface and a bottom surface for the direct or indirect formation of a seating surface on an upwardly oriented top surface of the top wall and the bottom surface of the top wall is aligned inwards and opposite to the top surface of the top wall in the use position, two two-part A-sidewalls to support the top wall on a floor, two B-sidewalls to support the top wall on a floor, two top wall parts, which are swivelable to each other outwards in a direction away from the interior volume with a top wall hinge, and form the top wall, each two A-sidewall parts per A-sidewall, which are jointly connected to each other with a sidewall hinge and are swivelable to each other, and each two A-sidewall parts form an A-sidewall, two top wall connection hinges and with each one top wall connection hinge one top wall part is jointly connected to one B-sidewall, so that the top wall parts are swivelable to the B-sidewalls, four sidewall connection hinges and with each one sidewall connection hinge one A-sidewall part is jointly connected to one B-sidewall, so that the A-sidewall parts are swivelable to the B-sidewalls, wherein the foldable seat comprises:

at least one locking device for locking of the two top wall parts in the use position of the seat and in a locked state of at least one locking device a swiveling of the two top wall parts with the top wall hinge is blocked to each other to an outside in a direction away from the interior volume to absorb compressive forces on the bottom surface of the top wall, so that the foldable seat additionally forms a storage box for storing objects on the bottom surface of the top wall with an orientation of the foldable seat with the bottom surface of the top wall upwards and the at least one locking device comprises each at least one form-fitting element and each at least one counter form-fitting element and in the locked state each of one locking device the at least one form-fitting element is form-fitting connected to at least one counter form-fitting element and the at least one form-fitting element is formed at the top wall and the at least one counter form-fitting element is formed at the A-sidewall or vice versa.

2. The foldable seat according to claim 1,
wherein,
with the at least one locking device additionally a swiveling of the two top wall parts to each other is blocked inwards in a direction to the interior volume.

3. The foldable seat according to claim 1,
wherein,
with the at least one locking device the top wall is detachably mounted in a form fitting and/e force-locking at an A-sidewall or at both A-sidewalls in the use position.

4. The foldable seat according to claim 1,
wherein:
with a first locking device the top wall is detachably fixed at a first A-sidewall and preferably with a second locking device the top wall is detachably fixed at a second A-sidewall in the use position.

5. The foldable seat according to claim 1
wherein,
each of the one form-fitting element has a support surface and each of the one counter form-fitting element has one counter-support surface and in the locked state each of the one support surface bears on each of the one counter-support surface.

6. The foldable seat according to claim 5,
wherein,
each of the one support surface and/or at least one counter-support surface is in the use position at least partially aligned in the main perpendicular to the A-sidewall.

7. The foldable seat according to claim 5,
wherein,
when used as a foldable storage box in the use position, the compressive force applied on the bottom surface of the top wall without a contact of the seat, in particular the top wall, with a floor at least partially applies as a compressive force between each of the one support surface and each of the one counter-support surface.

8. The foldable seat according to claim 1,
wherein,
each of the one form-fitting element is formed as a locking nose formed at the top wall or as a locking bolt formed at the top wall and each of the one counter form-fitting element is an area of the A-sidewall with the counter-support surface or is formed as a stub with a locking recess, in particular locking bore, formed at the A-sidewall
or
each of the one form-fitting element is formed as a locking nose formed at the A-sidewall or as a locking bolt formed at the A-sidewall and each of the one counter form-fitting element is an area of the top wall with the counter-support surface or is formed as a stub with a locking recess, in particular locking bore, formed at the top wall.

9. The foldable seat according to claim 1,
wherein
each of the one form-fitting element is stationary and immovably connected with the top wall or the A-sidewall and each of the one counter form-fitting element is movably connected by each one locking mechanism with the top wall or the A-sidewall
or
each of the one form-fitting element is movably connected by each one locking mechanism with the top wall or the A-sidewall and each of the one counter form-fitting element is stationary and immovably connected with the top wall or the A-sidewall.

10. The foldable seat according to claim 1,
wherein,
a geometry of the each one form-fitting element and the each one counter form-fitting element are complementary to each other.

11. The foldable seat according to claim 1,
wherein,
at end regions of the A-sidewall parts, which are connected by the sidewall hinges jointly, hinge bores are formed and each one sidewall hinge is formed by a hinge axis arranged in the hinge bores of two A-sidewall parts.

12. The foldable seat according to claim 1,
wherein
the seat in the use position is in a main cuboid-shaped, in particular in the main cube-shaped, without floor wall and the bottom surfaces of the A-sidewalls and B-sidewalls function for support on a floor and in the main cuboid-shaped means that the foldable seat with a deviation of less than 30%, 20% or 10% with regard to the length and width and height is formed as a cuboid, in particular cube.

13. The foldable seat according to claim 1,
wherein
in the use position each of two A-sidewall parts per A-sidewall are in a main parallel to each other and/or at an angle of in a main 180° to each other and/or are arranged in one plane and with at least one limit stop a swiveling of each of the two A-sidewall parts per A-sidewall is blocked from this position to the outside and in the main parallel and/or in the main aligned at an angle of 180° to each other means with a deviation of less than 30°, 20° or 10°.

14. The foldable seat according to claim 13,
wherein
the each one hinge axis is in the direction of a longitudinal axis of the hinge axis and/or swivel axis of the sidewall hinge is movably supported, so that in a locked position in the locked state of the at least one locking device of the hinge axis, the hinge axis is arranged in the recess and in a unlocked position in the unlocked state of the at least one locking device, the hinge axis is arranged outside the recess, so that in the unlocked position the two A-sidewall parts are swivelable to each other, in particular inwards in a direction to the interior volume.

15. The foldable seat according to claim 13,
wherein in the locked position each one hinge axis is fixable with a fixing means, in particular in the use position of the foldable seat.

16. The foldable seat according to claim 1, wherein the volume of the seat in the storage position is less than 50% or 30% or 20% of the volume of the seat in the use position.

17. The foldable seat according to claim 1, wherein in the use position an end as form-fitting element of each one hinge axis is arranged in a recess as counter form-fitting element at the top wall, so that a swiveling of each two A-sidewall parts, especially inwards in a direction to the interior volume, is blocked.

* * * * *